United States Patent [19]

Spring

[11] 4,388,776

[45] Jun. 21, 1983

[54] PNEUMATICALLY OPERATED TOY EMPLOYING A MOVABLE IMPLEMENT

[75] Inventor: Gorden W. Spring, Norwalk, Calif.

[73] Assignee: Tomy Corporation, Carson, Calif.

[21] Appl. No.: 260,692

[22] Filed: May 5, 1981

Related U.S. Application Data

[63] Continuation-in-part of Ser. No. 159,774, Jun. 16, 1980, abandoned.

[51] Int. Cl.[3] ..... A63H 29/16

[52] U.S. Cl. ..... 46/44; 46/39

[58] Field of Search ..... 46/44, 39, 40, 41, 248, 46/90; 60/370, 533, 545, 591, 594; 417/384, 388

[56] References Cited

U.S. PATENT DOCUMENTS

| | | | |
|---|---|---|---|
| 981,530 | 1/1911 | Canty | 60/370 |
| 1,400,188 | 12/1921 | Tooker | 417/388 |
| 3,423,937 | 1/1969 | Wagstaffe | 60/594 |
| 3,565,182 | 2/1971 | Teasdale | 60/533 X |
| 3,605,326 | 9/1971 | Baginski et al. | 46/44 |
| 3,695,148 | 10/1972 | Baginski et al. | 60/533 X |
| 3,757,463 | 9/1973 | Breslow et al. | 46/44 X |
| 4,159,705 | 7/1979 | Jacoby | 46/44 X |
| 4,162,106 | 7/1979 | Lawrence et al. | 46/44 X |
| 4,272,909 | 6/1981 | Tsui | 46/44 X |

*Primary Examiner*—F. Barry Shay

*Attorney, Agent, or Firm*—K. H. Boswell; Edward D. O'Brian

[57] ABSTRACT

A toy is constructed utilizing an air compressor to supply cycling positive and negative fluid pressure to an output cylinder. A piston is associated with the output cylinder and moves with respect to the output cylinder in response to cycling fluid pressure supplied to the output cylinder. Movement of the piston in turn moves an implement operatively connected to it. With respect to at least negative pressure, the piston or a valve element connected therewith is constructed so as to permit air to move through the cylinder without movement of the piston in the event that the implement is, for any reason, reasonably restrained against movement. The movement of the fluid through the cylinder without concurrent piston movement avoids possible damage to whatever is restraining the implement against movement and additionally avoids possible damage to the toy.

9 Claims, 3 Drawing Figures

PNEUMATICALLY OPERATED TOY EMPLOYING A MOVABLE IMPLEMENT

CROSS REFERENCE TO RELATED APPLICATIONS

This application is a continuation-in-part of my invention entitled PNEUMATICALLY OPERATED TOY EMPLOYING A MOVABLE IMPLEMENT filed June 16, 1980, Ser. No. 159,774, now abandoned the entire disclosure of which is herein incorporated by reference.

BACKGROUND OF THE INVENTION

The invention set forth in this specification pertains to new and improved pneumatically operated toys employing movable implements.

In the past a number of toys have been developed utilizing a structure such as a bellows to supply air pressure to a line so as to in turn cause mechanical movement at the end of the line through the use of another structure such as, for example, another bellows. While toys constructed in this manner are unquestionably utilitarian, they are not considered to be particularly desirable in many applications. Should even the smallest air leak develop, the ability of the first bellows to inflate the second is severely compromised. This requires a closed system which has inherent safety disadvantages.

When an implement coupled to the structure operated in response to air pressure is even partially restrained against movement there is a reasonable possibility of whatever is restraining the implement against movement or of the toy itself becoming damaged. Obviously such damage would be undesirable. If, for example, the implement was partially restrained against movement as a result of contact with an eye or an ear of a child there is a significant chance that the child might become injured. The possibility of such damage is particularly significant in cases where compressed air is used to operate simulated tools or other implements reasonably corresponding to adult tools such as chisels, drills and the like.

SUMMARY OF THE INVENTION

A broad objective of the present invention is to provide new and improved pneumatically operated toys employing movable implements. More specifically, the invention is intended to provide toys of this type which are constructed in such a manner that there is reduced possibility of damage or injury occurring as a result of the use of these toys for play purposes in circumstances where for one reason or another the implement is at least partially restrained against normal movement. Such restraint can be accomplished as a result of the implement contacting a comparatively hard object or surface such as, for example, a part of the body of the user of a toy or a comparatively hard surface of any type. The invention is further intended to provide toys as indicated which may be easily and conveniently constructed at a comparatively nominal cost and which are capable of prolonged reliable utilization.

It is a further object of the present invention to provide a toy which can be so constructed so as to position the piston within an output cylinder or to position the piston in association with a flexible body having a hollow interior which is connected to the output chamber and which is capable of flexure in response to pressure changes in the chamber with the flexure of the movable body communicating movement of the piston to move the same.

The above objects and others, as will become evident from the remainder of this specification, are achieved by providing a toy of the type which includes a fluid compressor means in which an improvement comprises: said fluid compressor means including a first connecting port serving as a fluid passageway between the exterior of said fluid compressor means and the interior of said fluid compressor means, said fluid compressor means being constructed so as to provide a cycling positive and negative fluid pressure at said port; a motor means operatively associated with said fluid compressor means and capable of causing movement of at least a portion of said fluid compressor means, said fluid compressor means providing said cycling positive and negative fluid pressure in response to said movement; a flexible fluid line including coupling means located at its respective ends; one of said coupling means at one of said ends of said line attaching to said first port so as to connect the interior of said fluid line to said fluid compressor means and provide cycling positive and negative fluid pressure at the other of said ends of said line; an output chamber including a second port, said second port serving as a fluid passageway between the exterior of said chamber and the interior of said chamber, the other of said coupling means connecting the other of said ends of said line to said second port and providing cycling positive and negative fluid pressure at said second port in response to said cycling pressure at said first port; a piston operatively associated with said chamber and capable of moving with respect to said chamber in response to fluid pressure within said chamber; an implement operatively connected to said piston and movable in response to movement of said piston with respect to said chamber; means associated with said chamber and responsive to at least said negative pressure at said second port so as to allow fluid passage through at least a portion of said chamber without movement of said piston with respect to said chamber.

The piston can be located within the interior of the chamber and be capable of reciprocating in the chamber in response to the cycling positive and negative pressure introduced into the chamber via the second port. The implement will move in response to the cyclic movement of the piston within the chamber.

Preferredly the outer periphery of the piston is less than the inner periphery of the chamber; thus a space exists between the piston and the chamber. This space can serve as the above noted means associated with the chamber which is responsive to said pressure.

The chamber can include an opening to the ambient environment which is displaced away from the second port such that the piston is interspaced between this opening and the second port. When the implement is directly connected to the piston movement of one or the other of the implement or the piston is, of course, correspondingly transferred to the other and restraining of the implement or the piston is likewise transferred to the other. If for any reason the implement is restrained from movement while the toy is in an operating mode and positive and negative pressures are being supplied to the second port, the space between the piston and the chamber serves to allow fluid passage toward or away from the second port, depending upon whether or not the second port is at a positive or negative fluid pressure without movement of the implement.

The piston divides the chamber into a portion proximal to the second port and a portion distal to the second port. The volume of the proximal portion increases in response to positive pressure at the second port with an accompanying decrease in the volume of the distal portion and vice versa with presence of a negative pressure at the second port. The chamber can include an opening between the ambient environment and the distal portion allowing for fluid flow between the distal portion and the ambient environment in response to movement of the piston within the chamber.

In an alternate embodiment of the invention the toy can include a piston moving means connected to the chamber. At least a portion of the piston moving means would have a hollow interior and this portion of the interior would be connected to the chamber such that fluid can flow between this portion of the interior of the piston moving means and the chamber. The piston is directly associated with the piston moving means such that fluid flow into the chamber in response to positive pressure at the second port results in fluid flow into the piston moving means causing the piston moving means to move the piston in a first direction. Fluid flow out of the chamber causes fluid flow from the interior of the piston moving means into the chamber such that the piston can move in a second direction.

In this second embodiment preferredly the chamber can be divided into a first section and a second section. The above noted portion of the interior of the piston moving means would connect to the second section. A first valve means can be located between the first and second sections and be capable of allowing fluid flow from the first section into the second section. A second valve means can be located between the first section and the ambient environment and allow fluid flow from the ambient environment into the first section. A third valve means can be located between the second section and the ambient environment and allow fluid flow from the second section to the ambient environment. For movement of the piston in response to positive pressure at the second port, fluid would flow from the second port into the first section and through the first valve means into the second section and into the piston moving means to move the piston in the first direction. The piston can be maintained in its position in the first direction upon reversal of the fluid pressure at the second port by fluid flow from the ambient environment through the first valve means into the first section and thus into the second port. Movement of the piston in the second direction can be effected by activation of the third valve means allowing fluid flow out of the piston moving means into the second section and from the second section into the ambient environment.

Preferredly the piston moving means would be constructed as a hollow imperforate expandable bellows. Expansion of said bellows in the first direction of said movement of said piston causes movement of said piston in said first direction and contraction of said bellows in the second direction of said movement of said piston causes movement of said piston in said second direction. Preferredly in said alternate embodiments the piston comprises a cylinder having an open end and a hollow interior with said bellows fitting through said open end into said hollow interior.

Preferredly the toy of the invention will include both said first and said alternate embodiment such that both embodiments can be used in conjunction with one another during play of the toy. Both of said embodiments would include a second port such that the fluid line from the compressor means can be conveniently switched between the second ports of the embodiments allowing the user of the toy to incorporate both embodiments within a single play reference frame.

BRIEF DESCRIPTION OF THE DRAWINGS

This invention will be better understood when taken in conjunction with the drawings wherein.

The toy illustrated in these drawings and described in this specification utilizes certain principles and/or concepts as are set forth in the claims attached to this specification. Those skilled in the toy art will realize that these principles and/or concepts are capable of being expressed in a number of different embodiments differing from the exact embodiments illustrated herein. For this reason this invention is to be construed in light of the claims and is not to be construed as being limited to the exact illustrative embodiments depicted herein.

DETAILED DESCRIPTION OF THE INVENTION

Figure 1:
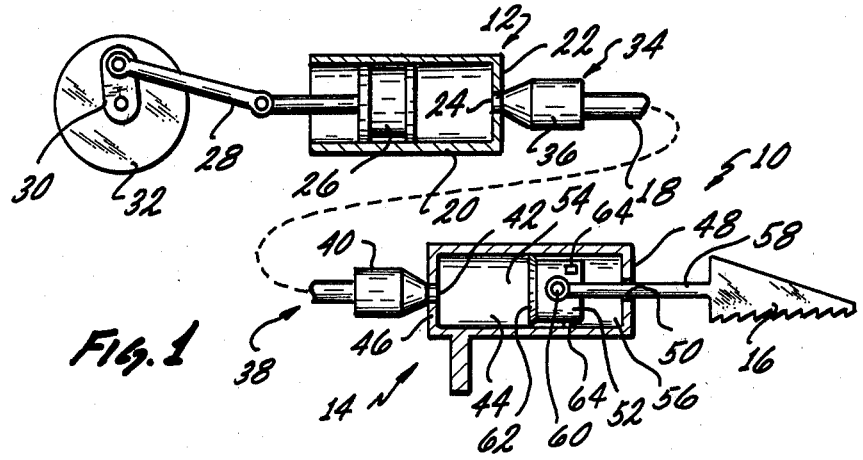
FIG. 1 is a diagrammatic view, partially in section, showing the first embodiment of the toy.

Referring now to FIG. 1 of the drawings there is shown a pneumatically operated toy 10 in accordance with this invention which utilizes an air compressor 12 and has an output means 14 for providing mechanical movement in response to operation of the fluid compressor 12 (normally air is used as the working fluid). Attached to the output means 14 is an implement 16. As depicted, the implement 16 is shown as a saw. The implement 16, however, may be of any one of a number of desired shapes or forms, preferredly a form mimicking an analogous full size tool, or the implement could be in fact an actuator for another mechanism (not numbered or shown). Linking the air compressor 12 and the output means 14 is a hollow fluid line 18. The fluid line 18 would be formed of a conventional tube or hose which is preferredly sufficiently nonelastic so as not to be capable of being deformed to any significant or noticeable extent at the working pressures of the toy 10. These pressures are normally only nominally different from that of atmospheric pressure due to the nature of the toy 10 where preferredly the force driving the air compressor 12 would be a small battery powered motor compatible with the toy 10.

The air compressor 12 includes a compressor cylinder 20 having an end 22 in which is located a first port 24. A conventional piston 26 is slidably mounted within the cylinder 20. The piston 26 is adapted to be moved in the cylinder 20 through the use of a conventional connecting rod 28 carried on a crank arm 30. The crank arm 30 is carried on the output shaft of a conventional motor 32. Preferredly the motor 32 would be a small battery powered motor suitable for use in the toy 10. Optionally the motor 32 could comprise a normal spring wound motor as is also found in conventional toys. In any event, the motor 32 would be sufficient such that it rotated crank arm 30 which in turn would drive connecting rod 28 and move piston 26 reciprocally in the cylinder 20.

The piston 26 is of a sufficient diameter such that a fluid seal is formed between it and the inside of the cylinder 20. Movement of the piston 26 in a reciprocal or cyclic manner within the cylinder 20 causes the creation of an alternate positive and negative pressure at the first port 24. This is a simple result of an increase or decrease in the volume of the cylinder 20 located between its end 22 and the top of the piston 26. The cylinder 20 would normally be formed of a hard plastic with the piston 26 formed of a more flexible plastic capable of forming a sliding seal with the cylinder 20.

End 34 of line 18 includes a connector 36 thereon. The connector 36 is adapted to fit into the first port 24 and form a reasonably fluid tight seal with this port 24. The line 18 is hollow such that after the connector 36 is inserted into the port 24 the alternating or cycling fluid pressure created within the cylinder 20 is transferred through the port 24 to the interior of the line 18 and is propagated within the interior of this line. The other end 38 of line 18 includes a connector 40 thereon. The connector 40, like the connector 36, is preferredly a male connector and is adapted to easily fit into a suitable port located in the output means such as the output means 14 of the embodiment shown in FIG. 1.

In the embodiment of FIG. 1 the output means 14 includes an output chamber 44 having a port 42 in one of its ends 46. Insertion of the connector 40 into the port 42 thereby propagates the reciprocating positive and negative pressure created within the compressor cylinder 20 to the output cylinder 44. Located in the other end 48 of output chamber 44 is an opening 50.

A piston 52 located within the output chamber 44 divides the chamber into a first section 54 and a second section 56. The first section 54, of course, would be proximal to the port 42 and the second section 56 would be distal to this port. A connecting rod 58 attaches to piston 52 via pin 60. The connecting rod 58 passes through the opening 50 and attached to its other end is the implement 16.

Preferredly the connecting rod 58 does not fit snugly within the opening 50 in the chamber 44. This allows for free sliding movement of the connecting rod 58 and also allows for pressure equalization of the distal section 56 of the chamber 44 with the ambient fluid pressure surrounding the outside of the output chamber 44.

The piston 52 can include a skirt or flange 62 located on it. Preferredly the skirt or flange would project radially away from the walls of the piston 52 and converge onto itself to form a fine edge on its outermost periphery. In effect then, a cross-section of this skirt or flange projects out away from the piston and comes together at this fine edge in a V shaped manner. When this skirt or flange is incorporated as part of the piston 52, the outside periphery of the skirt or flange 62 is sized such that it is smaller that the inside periphery of the chamber 44. These dimensions are chosen such that the skirt or flange 62 does not form a perfect seal with the output cylinder 44. The seal that is formed is sufficient such that in response to positive or negative pressure transmitted through the line 18 to the second port 42, the piston 52 will reciprocate back and forth within the chamber 44 when the implement 16 is unrestrained. If for any reason the implement 16 is reasonably restrained, such as if this implement was located against a body part, the seal between the skirt or flange 62 with the interior of the output cylinder 44 is such that there would be fluid leakage through the space formed by the outermost periphery of the skirt or flange 62 and the innermost periphery of the output cylinder 44. The fluid leakage through this space would allow for fluid movement into and out of the proximal section 54 of the chamber 44.

The piston 52 can be constructed without including the skirt or flange 62. As so constructed the piston 52 itself would have an outer periphery that is slightly smaller than inner periphery of the chamber 44. Thus the whole wall of the piston 52 would be spaced slightly away from the interior wall of the output chamber 44 forming a finite space between the piston 52 and the output cylinder 44 for air leakage past the piston 52.

With or without the inclusion of the skirt 62 the piston 52 is preferredly formed of a somewhat resilient material such as common low density grade polyethylene. When the skirt or flange 62 is included on the piston 52 this skirt or flange would be formed of the same material and thus would be capable of temporary deformation if subjected to sufficiently great positive or negative pressures. This would insure further safety of the toy 10. Thus the skirt or flange 62 would be capable of deforming, enlarging the space between the outermost periphery of the piston 52 and the innermost periphery of the output chamber 44.

In any event, the piston 52 is of sufficient size compared to the output chamber 44 such that the exposure of the piston 52 to an alternate positive and negative pressure within the proximal section 54 of the chamber 44 causes the piston 52 to alternately cycle back and forth within the chamber 44 towards and away from the ends 46 and 48 of the chamber 44 respectively. In response to this alternately back and forth movement of the piston 52 in the chamber 44, motion of the piston 52 is transferred via the connecting rod 58 to the implement 16 causing movement of the implement 16 with respect to the output chamber 44. The movement of the implement 16 simulates the working of the actual tool or the like after which it is modeled.

Because of the oversize of opening 50 with respect to the connecting rod 58, fluid can freely move into and out of the distal section 56 of the chamber 44 in response to movement of piston 52 within this chamber. This equalizes the pressure within this distal section 56 of the chamber 44 which if not equalized would tend to modify or prevent free piston travel within the chamber. In effect, piston 52 is first pushed away by positive fluid pressure in proximal section 54 from end 46 toward end 48 of the output chamber 44, then is sucked in the opposite direction from end 48 toward end 46 in response to negative pressure in the proximal section 54 of the chamber 44.

If desired, the piston 52 could also include a series of lugs collectively numbered by the numeral 64 equally spaced around the perimeter of the piston 52. These would prevent the piston 52 from becoming crocked or canted during use and thus bind up within the interior of the output cylinder 44. If, of course, no skirt or flange 62 is included on the piston 52 these lugs would also not have to be included because the cylindrical surface of piston 52 itself would serve to prevent it from becoming crocked or canted within the output cylinder 44 upon moving back and forth.

It can be seen that a variety of implements 16 could be utilized with the embodiment of FIG. 1; it only being necessary to include an appropriate connecting rod 58 formed as part of the implement which could attach via a pin 60 to the piston 52 in order to facilitate movement of the implement 16 with respect to the output chamber 44.

In use, the toy 10 is operated by activating the motor 32 such that the crank arm 30 appropriately rotates moving the piston 26 via the connecting rod 28. The movement of the piston 26 within the compression cylinder 20 produces the alternating positive and negative pressure within this cylinder which is propagated through the line 18 to the output chamber 44. Positive pressure within the air line 18 results in movement of the piston 52 toward end 48 and negative pressure within the air line 18 causes movement of the piston 52 toward the end 46.

Because of the space inbetween either the periphery of the skirt or flange 62 and the output chamber 44 or periphery of the piston 52 and output chamber 44, there will be a minor amount of leakage both past the piston from the proximal section 54 to the distal section 56 upon a positive pressure within the air line 18 and from the distal section 52 to the proximal section 54 when there is negative pressure in the air line 18. These positive and negative air pressures are taken with respect to the ambient pressure outside of the toy 10. If the skirt or flange 62 is utilized, the piston 52 will better mimic the movement of the piston 26 than without it; however, by appropriately choosing the space between either the skirt or flange 62 or the outside of the piston 52 and the inside of the output chamber 44 positive movement of piston 52 will be accomplished in response to movement of the piston 26.

In case of restrainment of the implement 16 the positive or negative pressure created within the proximal section 54 can be alleviated by fluid movement through the space between the distal section 56 and proximal section 54. The skirt or flange 62 being formed of a material which will temporarily flex and deform, will further increase the amount of fluid which can circumvent around the piston 52 in case of restrainment of the implement 16. It can be seen that these features mentioned above significantly minimize the chance of implement 16 being moved in a manner which could cause damage or injury. When unimpeded, however, the implement 16 still moves in a manner successfully mimicking operation of a full scale machine such that the user of the toy can equate the operation of the toy 10 with that of its full scale counterpart.

If for some reason the implement 16 is restrained and the piston 52 gets out of sinc with regard to the movement of piston 26, as soon as restrainment of the implement 16 is released the toy 10 will automatically recoordinate the movement of the piston 52 with the movement of piston 26. That is, as the piston 26 moves away from the first port 24 causing a negative pressure throughout the system, the piston 52, if not displaced toward end 46 of the output chamber 44, will become so displaced and if it is already located at this position, air will leak around piston 52 to neutralize the negative pressure being produced in the system by the movement of the piston 26. When once again positive pressure is induced into the system via movement of the piston 26 in the other direction the piston 52 will mimic such movement. This same effect would occur if in fact the piston 52 were displaced toward end 48 of the output chamber 44 except positive pressure in the system would be relieved by air leakage from the internal of the system around the piston 52 and out the opening 50 and thus relieve this positive pressure and as soon as a negative pressure was created within the system the piston 52 would be free to start its normal travel.

Figure 2:
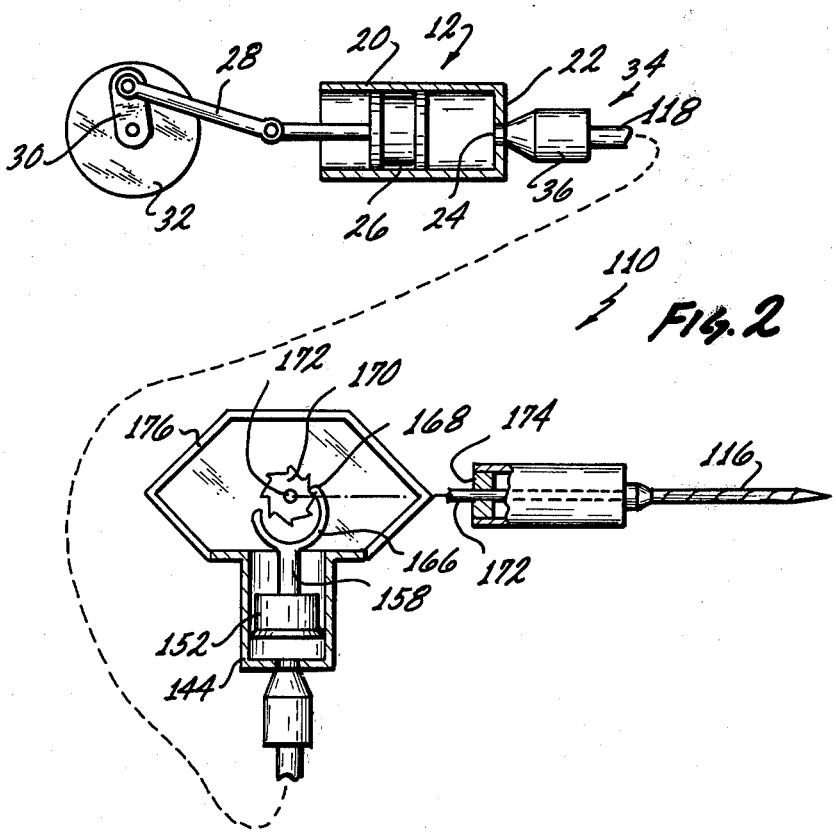
FIG. 2 is a view corresponding to FIG. 1 of a somewhat modified rendition of this first embodiment of the toy.

In FIG. 2 an alternate embodiment of the output means 14 is shown. Since all of the components of the air compressor 12 are the same as that utilized in FIG. 1, the same numbers for these components have likewise been used in FIG. 2. For any part which has an equivalent to a part previously described in FIG. 1 the part shown in FIG. 1 will be utilized with the same characters used to identify that part as previously used with the exception that the previous numeral used will be preceeded by a numeral 1, thus the toy 10 of FIG. 1 is the toy 110 of FIG. 2.

A piston 152 operates within an output chamber 144 as was previously described for the above described embodiment. A connecting rod 158 connects to the piston 152. The connecting rod 158 carries on it a spring like arm 166 having a pawl 168 located on its extremity (not separately numbered) remote from the connecting rod 158. The pawl 168 is adapted to contact with a ratchet wheel 170 mounted upon an elongated shaft 172. The shaft 172 is in turn rotatively mounted on a bearing structure 174 which in turn is mounted on a housing 176 attaching to the output chamber 144. The housing 176 protects the components located inside from dirt, dust and the like. It is noted that the distal end 156 of the chamber 144 opens to the interior of the housing 176 such that there is no resistance from this side of the chamber 144 with regard to the air pressure impeding the movement of the piston 152. An implement 116 formed as an extension of shaft 172 or attached thereto, moves in response to movement of the shaft 172.

Figure 3:
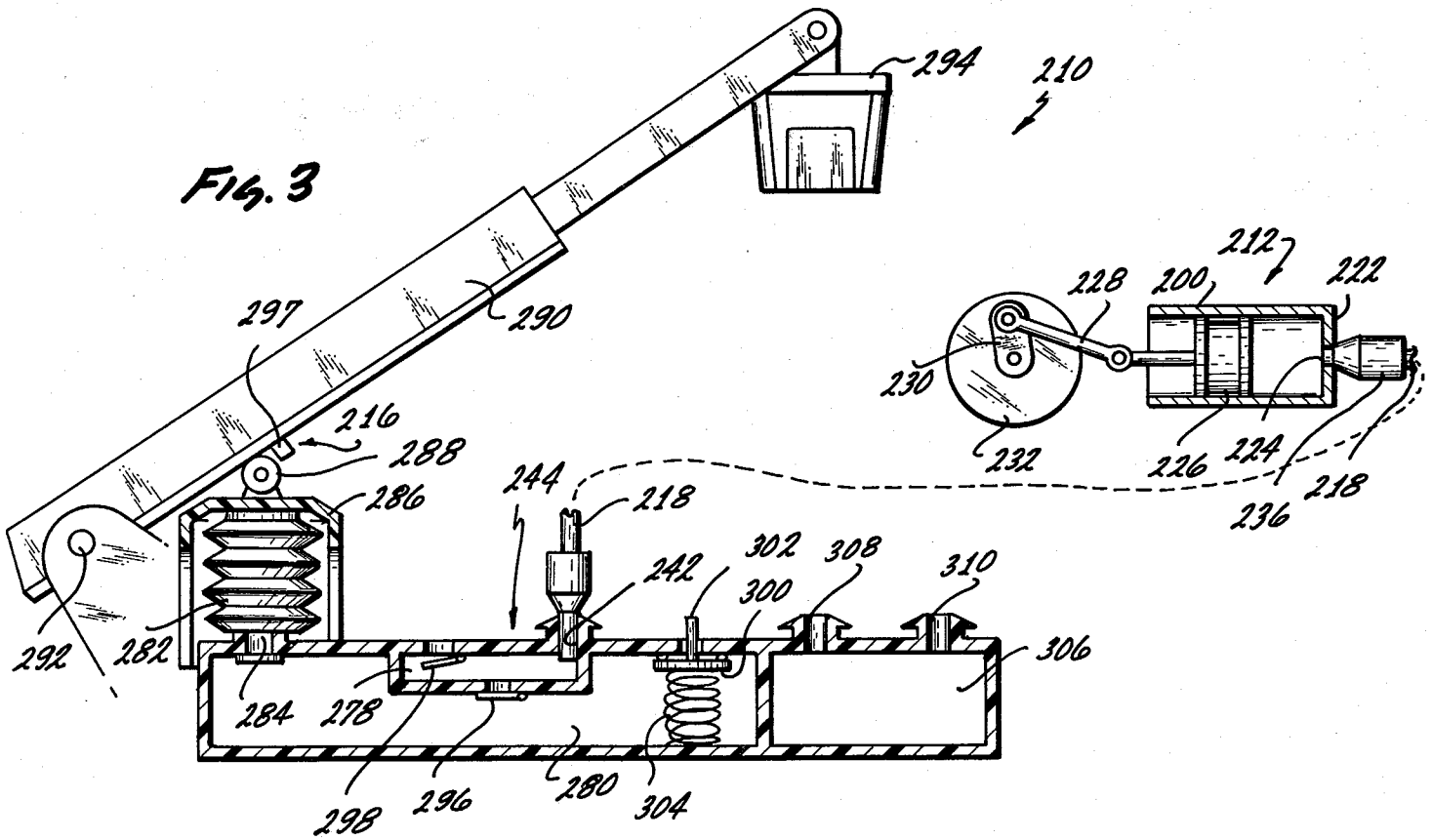
FIG. 3 is a diagrammatic view, partially in section, showing the alternate embodiment of the toy.

A further embodiment of the invention shown in FIG. 3 also incorporates many of the parts previously described for the toy 10. The parts which are the same or are substantially the same as in the toy 10 will be identified by the same characters as were used for the toy 10 with the exception that for FIG. 3 the characters will be preceeded by the numeral 2. Thus the toy 210 is equipped with an air compressor 212 having the appropriate component parts previously described. This compressor 212 is linked via line 218 to a port 242 located in a chamber 244.

The chamber 244 is divided into two sections—a first section 278 and a second section 280. Connecting with second section 280 is a piston moving means comprising a bellows 282. The bellows 282 is made such that it is capable of flexing up and down when respectively inflated or deflated with fluid. The bellows 282 has a hollow interior 284 which connects with the interior of the second section 280 such that fluid is free to flow to the interior 284 to the second section 280. Surrounding the bellows 282 is a cylindrical 286 acting as a piston insofar as it moves up and down in response to the pressure within the interior of the bellows 282.

An implement 216 is in part composed of a wheel 288 which is rotatively mounted to the top of piston 286. The wheel 288 contacts the underneath side of a lever 290 forming the remainder of the implement which is freely pivoted about a pin 292. The pin 292 appropriately connects to a housing component (not shown or numbered) forming the outside motif of the toy. Attaching to the other end opposite the location of the pin 292 is a structure 294 which is moved by movement of the level 290. Normally the lever 290 constitutes a crane and the structure 294 would be a basket on the end of the crane. Movement of the piston 286 in response to flexing of the bellows 282 provides for movement of the bucket or structure 294 upward and downward as the lever 290 moves. The lever 290 includes a stop 297 on its bottom which inhibits the amount of upward travel of the wheel 280 along lever 290. This prevents overflexing of the bellows 282.

Located between first chamber 278 and the second chamber 280 is a first valve means 296. This valve means is a flapper valve located such that positive pressure in the first section 278 is communicated to the second section 280; however, negative pressure within the first section 278 is not communicated to this second section 280. Located between the first section 278 and the ambient environment is a second valve means 298. This valve means also a flapper valve allows for fluid flow from the ambient into the first section 278 upon inducement of negative pressure within first section 278 by negative pressure within the line 218 fed into the first section 278 via port 242. Negative pressure in the first section 278, however, is not communicated to the second section 280 because of the location of the valve means 296. A third valve means 300 is located between the second section 280 and the ambient environment such that positive pressure within the second section 280 can be relieved by depressing the stem 302 of the valve 300 against the bias of the spring 304 opening the second section 280 to the ambient environment and as such opening the interior 284 of the bellows 282 to the ambient environment causing deflation of the bellows 282.

The embodiment illustrated in FIG. 3 operates as follows. Upon the presence of positive pressure within the line 218 this positive pressure is communicated first to the first section 278 and through the valve 296 to the second section 280. The valve 298 prevents this positive pressure from being exited to the ambient environment from the first section 278 and the valve 300 prevents this positive pressure from being exited to the ambient environment from the second section 280. Positive pressure within the second section 280 inflates the bellows 282 to the amount equal to the volume of fluid introduced by this positive pressure. Upon reversal of the pressure in the line 218 negative pressure in the line 218 closes the valve 296 therefore maintaining the positive pressure within the chamber 280 while opening the valve 298 allowing ambient fluid to feed from the ambient environment into the first section 278 relieving the positive pressure in the line 218.

Once the bellows 282 is inflated such that the wheel 288 contacts the stop 297 further inflation of the bellows 282 by positive pressure is inhibited. Normally at this time the operator of the toy would disconnect the line 218 from the port 242. The bellows 282 would stay extended and the lever 290 would be maintained in an extended position until it was desirable to release the pressure within the second chamber 280 by depressing the stem 302 of the valve 300. The valve 300 is normally sealed to the ambient environment by the presence of the spring 304 thus containing the fluid under pressure within the second section 280. Additionally, when the line 218 is disconnected from the port 242, the pressure from within the second chamber 280 is maintained by the valve 296 thus maintaining the extension of the bellows 282 depending on the pressure therein.

The embodiment depicted by the toy in FIG. 3 can include an auxiliary chamber which is useful to act as an intermediate station for propagating the pressure of the compressor 12 to any implement, whether it be implement 16, 116 or 216 or some other implement. In this respect a chamber 306 has an inlet 308 and an outlet 310 thereon. By appropriately coupling the inlet 308 to a line 18, which is attached to a compression means 12, a positive and negative pressure can be expressed at the outlet 310 for coupling of a second line 18 which in turn will feed an implement. Thus in the production form of the toy the compressor 12 is formed as a part of a truck or other type structure and the embodiment of FIG. 3 can form a trailer or the like having a boom, etc. The boom can be raised and lowered as per the embodiment shown in FIG. 3 and when the boom was placed in an appropriate position the user of the toy can then connect other implements such as implement 16 or 116 by feeding fluid to them through the chamber 306. This gives the effect of having an auxiliary or slave unit such as a trailer which can be appropriately coupled with a truck to make for a more realistic play value when used by a child.

As an added safety feature, since the lines 18, 118 or 218 are coupled via connectors 36, 40 or other similar connectors, excess positive pressure within the system can be relieved by slipping of the connectors 40, etc., from the ports 42, etc., to relieve this pressure. Under normal use, however, the air compressor 12 of the toy 10 and the other like compressors of the other embodiments, do not develop sufficient pressure to warrant any more sophisticated type of couplings other than the described frictional fit couplings fitting into the ports.

I claim:

1. A toy of the type including a fluid compressor means in which an improvement comprises:

said fluid compressor means including a first connecting port serving as a fluid passageway between the exterior of said fluid compressor means and the interior of said fluid compressor means, said fluid compressor means being constructed so as to provide a cycling positive and negative fluid pressure at said port;

a motor means operatively associated with said fluid compressor means and capable of causing movement of at least a portion of said fluid compressor means, said fluid compressor means providing said cycling positive and negative fluid pressure in response to said movement;

a flexible fluid line including coupling means located at its respective ends;

one of said coupling means at one of said ends of said line attaching to said first port so as to connect the interior of said fluid line to said fluid compressor means and provide cycling positive and negative fluid pressure at the other of said ends of said line;

an output chamber including a second port, said second port serving as a fluid passageway between the exterior of said chamber and the interior of said chamber, the other of said coupling means connecting the other of said ends of said line to said second port and providing cycling positive and negative fluid pressure at said second port in response to said cycling pressure at said first port;

a piston movably connected to said chamber and means for moving said piston with respect to said chamber in response to fluid pressure within said chamber;

an implement operatively connected to said piston and movable in response to movement of said piston with respect to said chamber;

bypass means associated with said chamber and responsive to at least said negative pressure at said second port so as to allow fluid passage through at least a portion of said chamber without movement of said piston with respect to said chamber.

2. The toy of claim 1 wherein:

said piston is located within the interior of said chamber and is capable of reciprocating within said chamber in response to said cycling positive and negative fluid pressure, said implement moving in response to said cycling movement of said piston.

3. The toy of claim 2 wherein:

the outermost periphery of said piston is less than the innermost periphery of said chamber forming a space between the outermost periphery of said piston and the innermost periphery of said chamber;

said bypass means associated with said chamber comprising said space;

said chamber including an opening to the ambient environment, said piston interspaced between said second port and said opening;

said implement being directly connected to said piston whereby if one of said implement or said piston is moved the other is moved and if one of said implement or said piston is restrained from moving the other is restrained from moving such that if said implement is restrained from moving both said positive and said negative pressures at said second port result in fluid passage through said space between said second port and said opening in a direction resulting in equalization of said pressure at said second port compared to fluid pressure in the ambient environment.

4. The toy of claim 3 wherein:

said piston divides said chamber into a portion proximal to said second port and a portion distal to said second port, the volume of said proximal portion increasing and the volume of said distal portion decreasing in response to positive pressure at said second port and the volume of said proximal portion decreasing and the volume at said distal portion increasing in response to negative pressure at said second port, said opening connecting said distal portion to the ambient environment allowing fluid flow between said distal portion and the ambient environment.

5. The toy of claim 1 including:

said means for moving said piston comprising a piston moving means connecting to said chamber, said piston directly associated with said piston moving means, at least a portion of said piston moving means having a hollow interior, said hollow interior connected to said chamber allowing fluid flow between hollow interior and said chamber such that fluid flow into said chamber in response to positive pressure at said second port results in said fluid flow into said hollow interior causing said piston moving means to move said piston in a first direction and fluid flow from said hollow interior back into said chamber causes said piston to move in a second direction.

6. The toy of claim 5 wherein:

said chamber is divided into a first section and a second section, said hollow interior connecting to said second section, said second port connecting to said first section;

a first valve means located between said first and said second sections and capable of allowing fluid flow from said first section into said second section and inhibiting fluid flow from said second section into said first section;

a second valve means connecting between said first section and the ambient environment and allowing said fluid flow from said ambient environment into said first section and inhibiting fluid flow from said first section to the ambient environment;

a third valve means connecting said second section with said ambient environment and allowing fluid flow from said second section to the ambient environment;

fluid passing from said second port into said first section and through said second valve means into said second section and into said hollow interior in response to positive pressure at said second port, fluid flowing from the ambient environment through said second valve means into said first section in response to negative pressure at said second port, fluid passing from said hollow interior into said second section and through said third valve means to the ambient environment in response to opening of said third valve means, said piston moving in said first direction in response to fluid flow through said first valve means and said piston moving in said second direction in response to fluid flow through said third valve means.

7. The toy of claim 6 wherein:

said piston moving means comprises a flexible hollow and imperforate member, said member connected to said chamber such that a fluid can pass between said chamber and the hollow interior of said member, said member capable of expanding in said first direction in response to fluid flow from said chamber into said member causing said piston to move in said first direction and said member capable of contracting in said second direction in response to fluid flow from said member to said chamber and causing said piston to move in said second direction.

8. The toy of claim 7 wherein:

said member comprises a bellows expandable in said first direction and contractable in said second direction.

9. The toy of claim 8 wherein:

said piston comprises a cylinder having an open end and a hollow interior, said bellows fitting through said open end into said hollow interior.

* * * * *